US011105505B2

(12) United States Patent
Nonoyama

(10) Patent No.: US 11,105,505 B2
(45) Date of Patent: Aug. 31, 2021

(54) PREMIXING APPARATUS AND METHOD THEREOF

(71) Applicant: RINNAI CORPORATION, Nagoya (JP)

(72) Inventor: Masao Nonoyama, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 146 days.

(21) Appl. No.: 16/441,172

(22) Filed: Jun. 14, 2019

(65) Prior Publication Data

US 2019/0293281 A1 Sep. 26, 2019

Related U.S. Application Data

(62) Division of application No. 15/458,156, filed on Mar. 14, 2017, now abandoned.

(30) Foreign Application Priority Data

Apr. 1, 2016 (JP) ..... JP2016-073845

(51) Int. Cl.
*F23D 14/06* (2006.01)
*F23D 14/62* (2006.01)
(Continued)

(52) U.S. Cl.
CPC ..... *F23D 14/06* (2013.01); *F23D 14/60* (2013.01); *F23D 14/62* (2013.01); *F23N 1/027* (2013.01); *F23D 2900/14* (2013.01)

(58) Field of Classification Search
CPC ..... F23D 14/06; F23D 14/60; F23D 14/62; F23D 2900/14; F23N 1/027
(Continued)

(56) References Cited

U.S. PATENT DOCUMENTS 4,752,211 A * 6/1988 Sabin ..... F23N 1/027 431/90
6,604,938 B1 8/2003 Blaauwwiekel et al.
(Continued)

FOREIGN PATENT DOCUMENTS

JP 2015-230113 A 12/2015
JP 2015-230143 A 12/2015
KR 20110031003 A 3/2011

OTHER PUBLICATIONS

Extended European Search Report for European Patent App. No. 17164196.2 (dated Jun. 9, 2017).

*Primary Examiner* — Steven B McAllister
*Assistant Examiner* — Benjamin W Johnson
(74) *Attorney, Agent, or Firm* — Cermak Nakajima & McGowan LLP; Tomoko Nakajima

(57) ABSTRACT

A method of controlling a premixing apparatus that mixes fuel gas with air and supplies thus obtained air-fuel mixture, through a fan to a burner, includes at a time of changing over to a small-capacity state in which a first ventilation resistance in an air supply passage is increased and also in which a second ventilation resistance in a gas supply passage is increased, rotating a butterfly valve down to a closing side stop angle; and at a time of changing over to a large-capacity state in which the first ventilation resistance in the air supply passage is decreased and also in which the second ventilation resistance in the gas supply passage is decreased, rotating the butterfly valve up to an open-side stop angle.

2 Claims, 5 Drawing Sheets

(51) Int. Cl.
*F23N 1/02* (2006.01)
*F23D 14/60* (2006.01)

(58) Field of Classification Search
USPC ..... 431/354
See application file for complete search history.

(56) References Cited

U.S. PATENT DOCUMENTS

| | | | | |
|---|---|---|---|---|
| 2011/0139045 | A1 | 6/2011 | Zatti et al. | |
| 2015/0354810 | A1* | 12/2015 | Nakatani | F23D 14/34 431/354 |
| 2017/0284663 | A1 | 10/2017 | Nonoyama | |

* cited by examiner

PREMIXING APPARATUS AND METHOD THEREOF

This application is a Divisional of, and claims priority under 35 U.S.C. § 120 to, U.S. patent application Ser. No. 15/458,156, filed Mar. 14, 2017, and claims priority therethrough under 35 U.S.C. § 119 to Japanese Patent Application No. 2016-073845, filed Apr. 1, 2016, the entireties of which are incorporated by reference herein.

TECHNICAL FIELD

The present invention relates to a method of controlling a premixing apparatus that mixes fuel gas with air and supplies thus obtained air-fuel mixture, through a fan, to a burner.

BACKGROUND ART

As this kind of a method of controlling using a premixing apparatus, the following is known in Patent Document 1, i.e., JP-A-2015-230113; that is, a downstream end of that gas supply passage for supplying fuel gas which has interposed therein a flow control valve, is connected to a gas suction section disposed in an air supply passage on an upstream side of the fan. The premixing apparatus comprises: an air resistance changeover means for changing over, between high and low, a ventilation resistance in that section of the air supply passage which is on an upstream side of the gas suction section; and a gas resistance changeover means for changing over, between high and low, a ventilation resistance in that section of the gas supply passage which is on the downstream side of the flow control valve.

By the way, in case a proportional valve is used as the flow control valve, the proportional valve is controlled so that the fuel gas can be supplied in amount depending on the required combustion amount. Further, the rotation speed of the fan is controlled depending on the required combustion amount so that the excess-air ratio of the air-fuel mixture to be supplied to the burner becomes constant. However, in case the required combustion amount falls below a predetermined value and, as a result, the rotation speed of the fan falls below a lower limit rotation speed below which the proportional characteristics of the air supply amount cannot be maintained, or in case the electric current to the proportional valve (electric current to be charged to the proportional valve) has fallen below a lower limit electric current below which the proportional characteristics of the gas supply amount cannot be maintained, the air or fuel gas in amount depending on the required combustion amount can no longer be supplied.

In addition, as the flow control valve, there is a case in which is used a zero governor that maintains the secondary gas pressure at the atmospheric pressure. In this case, the amount of fuel gas supply varies with the differential pressure between the atmospheric pressure that is the secondary gas pressure and the negative pressure inside the air supply passage. And since the negative pressure inside the air supply passage varies with the rotation speed of the fan, the amount of fuel gas supply varies with the rotation speed of the fan, i.e., the amount of air supply. Therefore, by controlling the rotation speed of the fan depending on the required combustion amount, the amount of air and fuel gas depending on the required combustion amount will be supplied to the burner.

Also in this arrangement, if the fan revolution has fallen below a lower limit revolution at which the proportional characteristics of the air supply amount can be maintained, the air or fuel gas depending on the required fuel amount can no longer be supplied. Therefore, when the required combustion amount has fallen below a predetermined amount, it is necessary to increase the ventilation resistance in the air supply passage by the air resistance changeover means. Then, without making the fan revolution below the above-mentioned lower limit value, the amount of air depending on the required combustion amount below the predetermined value can be supplied. Further, only by increasing the ventilation resistance in the air supply passage, the amount of fuel gas supply will exceed the amount corresponding to the required combustion amount due to an increase in the negative pressure in the air supply passage. It is therefore necessary also to increase the ventilation resistance in the gas supply passage at the time when the ventilation resistance in the air supply passage is increased.

As a solution, in the above-mentioned prior art example, the following arrangement has been employed; i.e., when the required combustion amount has fallen below the predetermined value, the ventilation resistance in the air supply passage is increased by the air flow resistance changeover means and also the ventilation resistance in the gas supply passage is increased by the gas resistance changeover means, thereby attaining a small-capacity state. It is thus made possible to supply the air and the fuel gas in amounts depending on the required combustion amount below the predetermined value. Further, when the required combustion amount has exceeded the predetermined value, the ventilation resistance in the air supply passage is decreased by the air flow resistance changeover means and, at the same time, the ventilation resistance in the gas supply passage is decreased by the gas resistance changeover means, thereby restoring a large-capacity state.

In the above-mentioned prior art described in Patent Document 1 (JP-A-2015-230113), the air resistance changeover means is provided in that section of the air supply passage which is on an upstream side of the gas suction section, and is constituted by a butterfly valve which is rotated into an opened posture in parallel with the longitudinal direction of the air supply passage and into a closed posture at right angles to the longitudinal direction of the air supply passage. The gas resistance changeover means, on the other hand, is constituted by a changeover valve which is disposed in the gas supply passage in a manner to allow for opening or closing. And there is disposed an interlocking mechanism which is so arranged as to open or close the changeover valve in interlocking with the rotation into an open posture or into a closed posture of the butterfly valve.

By the way, due to dimensional deviations and the like of the air supply passage, there is a case in which, in the small-capacity state in which the butterfly valve is rotated into the closed posture, the excess air ratio of the air-fuel mixture deviates from an appropriate value. Similarly, in the large-capacity state in which the butterfly valve is rotated into the opened posture, there is a case in which the excess air ratio of the air-fuel mixture deviates from an appropriate value. In such a case, by changing the diameter of the air supply passage, the excess air ratio can be made into an appropriate value. However, for that purpose, it becomes necessary to replace the related parts in the air supply passage, thereby requiring a considerable cost.

SUMMARY

Technical Problem

In view of the above point, this invention has a problem of providing a method of controlling a premixing apparatus in which an adjustment can be made without replacing the parts so that the excess air ratio of the air-fuel mixture can be made into an appropriate value in either of the small-capacity state and the large-capacity state.

Solution to Problem

In order to solve the above problem, this invention is a method of controlling a premixing apparatus that mixes fuel gas with air and supplies thus obtained air-fuel mixture, through a fan, to a burner, in which a downstream end of a gas supply passage having interposed therein a flow control valve for supplying fuel gas is connected to a gas suction section disposed in an air supply passage on an upstream side of the fan. The method of controlling a premixing apparatus comprises: an air resistance changeover means for changing over, between high and low, a ventilation resistance in that section of the air supply passage which is on an upstream side of the gas suction section; and a gas resistance changeover means for changing over, between high and low, a ventilation resistance in that section of the gas supply passage which is on the downstream side of the flow control valve, wherein the air resistance changeover means is constituted by a butterfly valve disposed in that section of the air supply passage which is on an upstream side of the gas suction section so as to be rotatable into an opened posture parallel with a longitudinal direction of the air supply passage or a closed posture at right angles to the longitudinal direction of the air supply passage, and wherein the gas resistance changeover means is constituted by a changeover valve disposed in the gas supply passage in an openable and closable manner, and has an interlocking mechanism to open or close the changeover valve in interlocking with the rotation of the butterfly valve into the opened posture or into the closed posture. The method of controlling a premixing apparatus is characterized in: that the interlocking mechanism maintains the changeover valve in a fully-closed state when the butterfly valve lies in a predetermined first rotation angle range inclusive of the closed posture, and maintains the changeover valve in a fully-opened state when the butterfly valve lies in a predetermined second rotation angle range inclusive of the opened posture; that the rotation angle of the butterfly valve at which the excess air ratio of the air-fuel mixture becomes a predetermined appropriate value within the first rotation angle range is set to be a closing-side stop angle of the butterfly valve; that the rotation angle of the butterfly valve at which the excess air ratio of the air-fuel mixture becomes a predetermined appropriate value within the second rotation angle range is set to be an open-side stop angle of the butterfly valve; and that the butterfly valve is controlled in rotation between the closing-side stop angle and the open-side stop angle.

Here, in the first rotation angle range, the changeover valve is maintained in the fully-closed state, and only the rotation angle of the butterfly valve changes. Therefore, due to this change, the ventilation resistance in the air supply passage changes and the excess air ratio of the air-fuel mixture also changes. Accordingly, even if the excess air ratio of the air-fuel mixture in the closed posture of the butterfly valve may have been deviated from the appropriate value, the excess air ratio of the air-fuel mixture can be made to be the appropriate value by the rotation of the butterfly valve within the range of the first rotation angle range. Similarly, even if the excess air ratio of the air-fuel mixture in the opened posture of the butterfly valve may have been deviated from the appropriate value, the excess air ratio of the air-fuel mixture can be made to be the appropriate value by the rotation of the butterfly valve within the range of the second rotation angle range. According to this invention, at the time of changing over to the small-capacity state in which the ventilation resistance in the air supply passage is increased and also in which the ventilation resistance in the gas supply passage is increased, the butterfly valve is rotated down to the closing-side stop angle at which the excess air ratio of the air-fuel mixture becomes the appropriate value within the first rotation angle range. Further, at the time of changing over to the large-capacity state in which the ventilation resistance in the air supply passage is decreased and also in which the ventilation resistance in the gas supply passage is decreased, the butterfly valve is rotated up to the open-side stop angle at which the excess air ratio of the air-fuel mixture becomes the appropriate value within the second rotation angle range. According to this arrangement, in either of the small-capacity state and in the large-capacity state, adjustments can be made to make the excess air ratio of the air-fuel mixture into the appropriate values without the necessity of replacing the parts.

By the way, it is at the time of rotating the butterfly valve to the closed posture that the excess air ratio of the air-fuel mixture becomes the lowest within the first rotation angle range. Therefore, the ignition operation of the burner shall preferably be performed in a state in which the butterfly valve is rotated to the closed posture. According to this arrangement, the ignition takes place in a state in which the excess air ratio of the air-fuel mixture is relatively low and in which the state is gas-rich and easily catching fire. Therefore, ignition failure can be prevented from occurring.

DESCRIPTION OF EMBODIMENTS

Figure 1:
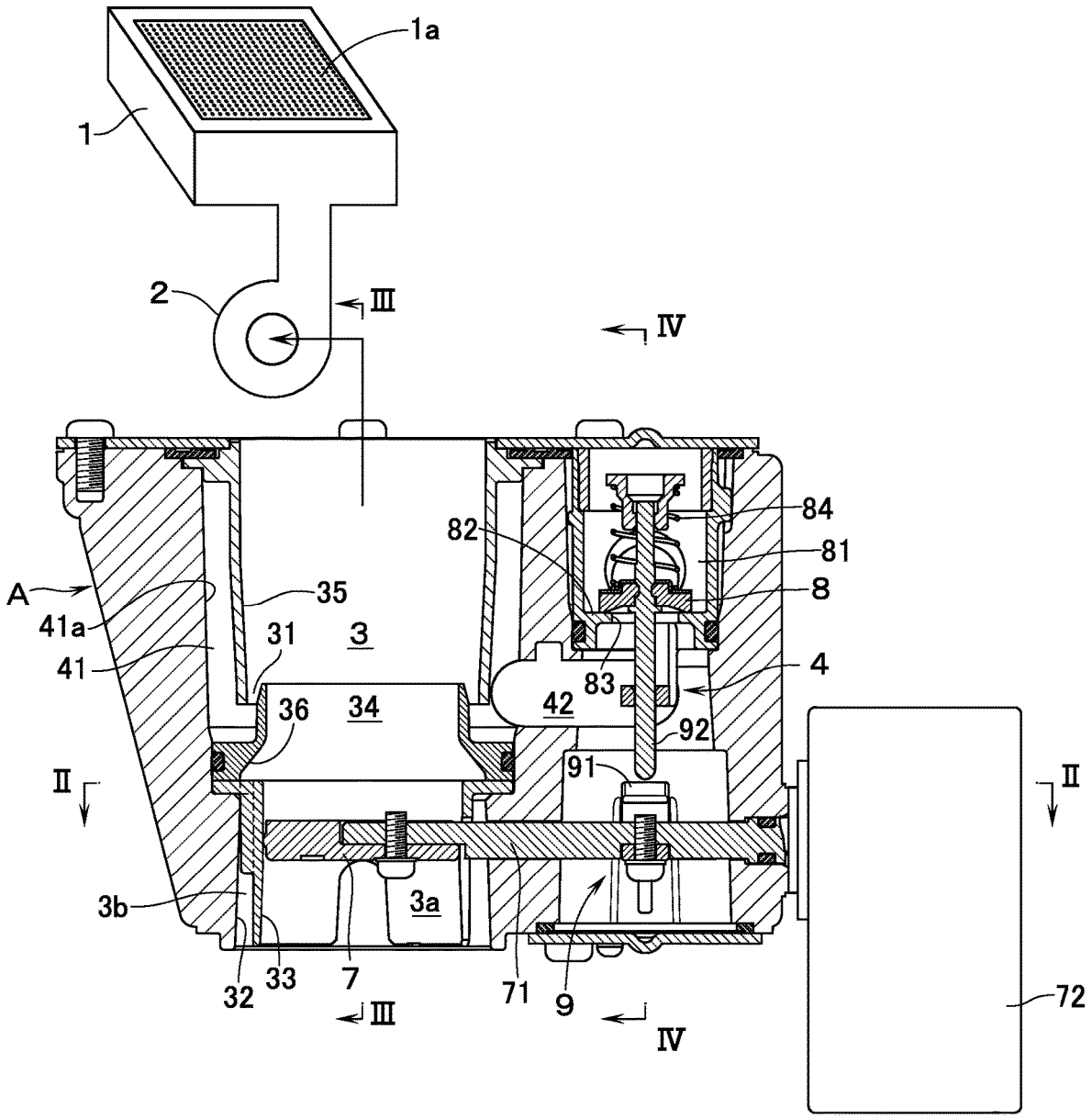
FIG. 1 is a side view, partly shown in section, of a premixing apparatus according to an embodiment of this invention.

With reference to FIG. 1, reference numeral 1 denotes a burner which is made up of a totally aerated combustion type burner (also called "all primary air burner") and the like having a combustion surface 1*a* in which the air-fuel mixture is ejected and combusted. The burner 1 has connected thereto a fan 2 and, by means of a premixing apparatus A according to an embodiment of this invention, the air is mixed with fuel gas and the air-fuel mixture thus obtained is supplied, through a fan 2, to a burner 11.

Figure 4:
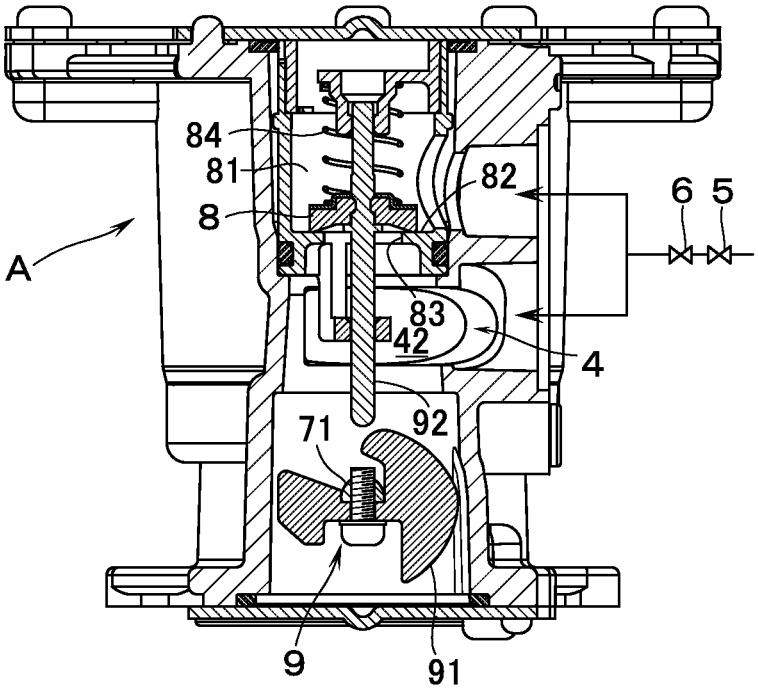
FIG. 4 is a sectional view partly cut away along the line IV-IV in FIG. 1.

The premixing apparatus A is provided with an air supply passage 3 on an upstream side of the fan 2, and a gas supply passage 4 to supply the fuel gas. In an upstream section of the gas supply passage 4, there are interposed a gate valve 5, and a flow control valve 6 which is made up of a proportional valve or a zero governor, as shown in FIG. 4. Further, the downstream end of the gas supply passage 4 is connected to a gas suction section 31 which is disposed in the air supply passage 3.

In addition, the premixing apparatus A is provided with: an air resistance changeover means for changing over, between high and low, a ventilation resistance in that section of the air supply passage 3 which is on an upstream side of the gas suction section 31; and a gas resistance changeover means for changing over, between high and low, a ventilation resistance in that section of the gas supply passage 4 which is on the downstream side of the flow control valve 6. When the required combustion amount has fallen below a predetermined value, a small-capacity state is attained in which the ventilation resistance in the air supply passage 3 is made high by the air resistance changeover means and also in which the ventilation resistance in the gas supply passage 4 is made high by the gas resistance changeover means. It is thus so arranged that the amount of air and fuel gas can be supplied depending on the required combustion amount below the required value. Further, when the required combustion amount has exceeded the predetermined value, a large-capacity state is attained in which the ventilation resistance in the air supply passage 3 is made low by the air resistance changeover means, and also in which the ventilation resistance in the gas supply passage 4 is made low by the gas resistance changeover means.

Figure 3:
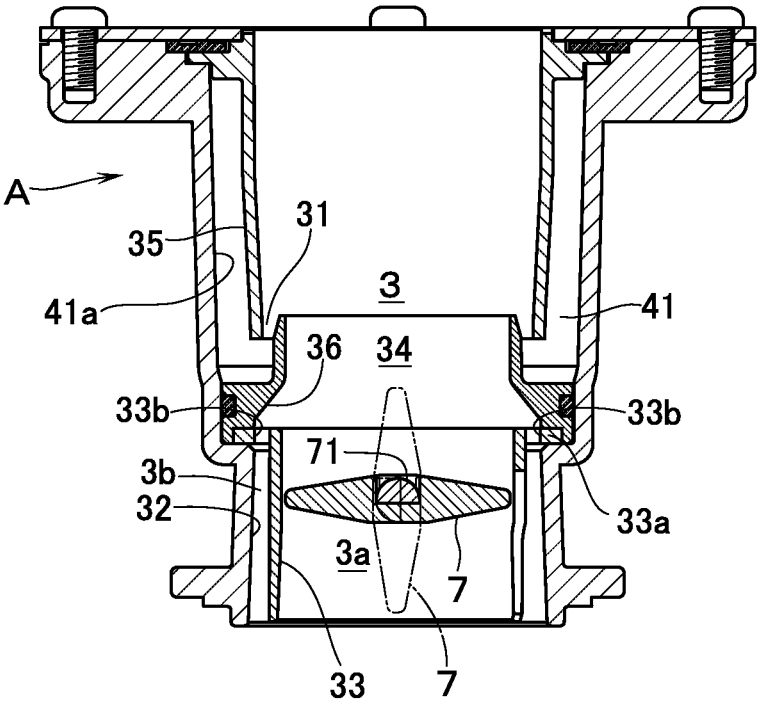
FIG. 3 is a sectional view partly cut away along the line III-III in FIG. 1.

In that portion of the air supply passage 3 which lies on an upstream side of the gas suction section 31, there is provided an inner tube 33 with a clearance to the inner circumferential wall surface 32 of the air supply passage 3. By the clearance between the inner circumferential wall surface 32 of the air supply passage 3 and the outer peripheral surface of the inner tube 33, there is constituted a subsidiary passage 3*b* which is in parallel with the main passage 3*a* inside the inner tube 33. In the flange section 33*a* on a downstream end (upper end in FIGS. 1 and 3) of the inner tube 33, there are formed a plurality of arcuate through holes 33*b* which serve as outlets to the subsidiary passage 3*b*.

Figure 2:
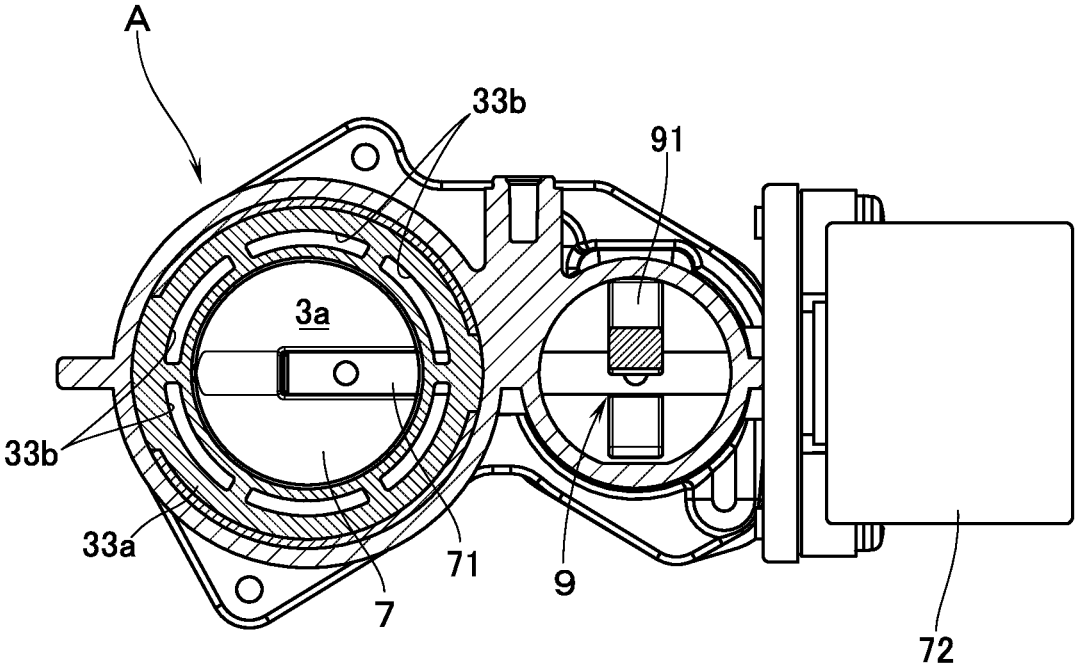
FIG. 2 is a plan view partly cut away along the line II-II in FIG. 1.

Inside the inner tube 33, there is disposed a butterfly valve 7 which is made up of a disc so as to be rotatable about a shaft 71. This butterfly valve 7 constitutes the air resistance changeover means. A shaft 71 of the butterfly valve 7 has connected thereto an actuator 72 such as a stepping motor and the like. At the time of changing over to the small-capacity state, the butterfly valve 7 is rotated, by the operation of the actuator 72, from the open posture side, which is in parallel with the longitudinal direction of the air supply passage 3, as shown by imaginary lines in FIG. 3 to a closed posture side, which is at right angles to the longitudinal direction of the air supply passage 3, as shown by solid lines in FIGS. 1 through 3. Further, at the time of changing over to the large-capacity state, the butterfly valve 7 is rotated, by the operation of the actuator 72, from the closed posture side to the open posture side. When the butterfly valve 7 is rotated to the closed posture, the main passage 3*a* is almost fully closed and the space through which the air flows is substantially limited to the subsidiary passage 3*b*, and the ventilation resistance in the air supply passage 3 becomes high.

That section of the air supply passage 3 which is adjacent to the upstream side of the gas suction section 31 is provided with a Venturi section 34 which is smaller in diameter than that section of the air supply passage 3 which has disposed therein the inner tube 33. That section of the air supply passage 3 which is adjacent to the downstream side of the Venturi section 34, is enclosed by a cylindrical section 35 which is larger in diameter than the Venturi section 34. Then, the downstream end section of the Venturi section 34 is inserted, while leaving an annular clearance, into an upstream end section. It is thus so arranged that this clearance constitutes a gas suction section 31 which is in communication with the gas chamber 41 by this clearance. In addition, the inner circumferential wall surface of the air supply passage 3 between the subsidiary passage 3*b* and the Venturi section 34 is formed into a tapered surface 36 with a smaller diameter toward the Venturi section 34.

The gas supply passage 4 is provided with a valve chamber 81 which is positioned on an upstream side of that gas chamber 41 on a downstream end of the gas supply passage 4 which is in communication with the gas suction section 31, the valve chamber being in parallel with a passage section 42 normally communicated with the gas chamber 41. Inside the valve chamber 81, there is provided a changeover valve 8 for opening or closing a valve hole 83 which is in communication with the passage section 42, the valve hole being formed in a valve seat 82 at the lower end of the valve chamber 81. The gas resistance changeover means is constituted by this changeover valve 8. When the changeover valve 8 is brought to a fully-closed state in which the changeover valve 8 is seated on the valve seat 82, thereby blocking the valve hole 83, the flow of the gas through the valve chamber 81 is shut off, and the ventilation resistance in the gas supply passage 4 increases.

The changeover valve 8 is operated to be opened or closed through an interlocking mechanism 9 accompanied by the rotation of the butterfly valve 7. This interlocking mechanism 9 is constituted, as shown in FIGS. 1 and 4, by: a cam 91 which is coupled to the shaft 71 of the butterfly valve 7; and a rod 92 which extends upward for connection to the changeover valve 8 and a lower end of which comes into contact with the cam 91. As a result of rotation of the butterfly valve 7, the rod 92 moves up and down through the cam 91, whereby the changeover valve 8 is operated to be opened or closed. In other words, when the butterfly valve 7 is rotated to the opened posture side, the cam 91 pushes up the rod 92. The changeover valve 8 moves up against the urging force of a valve spring 84, i.e., is operated to be opened. When the butterfly valve 8 is rotated to the closed posture side, the upward force of the rod 92 by the cam 91 is released. The changeover valve 8 moves downward by the urging force of the valve spring 84, i.e., is operated to be closed.

The interlocking mechanism 9 is arranged as follows, i.e., when the butterfly valve 7 lies within a predetermined first rotation angle range (e.g., 0° through 15°, where the angle of the butterfly valve 7 at the closed posture is defined to be 0°, and the angle of the butterfly valve 7 is at the opened posture is defined to be 90°), the changeover valve 8 is maintained at the fully-closed state, and when the butterfly valve 7 lies within a predetermined second rotation angle range (e.g., 75° through 90°), the changeover valve 8 is maintained at the fully-opened state. More specifically, it is so arranged that, when the butterfly valve 7 lies within the first rotation angle range, the rod 92 is free from contact with the cam 91 and that, when the butterfly valve 7 is rotated beyond the first rotation angle range into the opened side, the cam 91 comes into contact with the rod 92, and the rod 92 starts an upward movement. Further, an arrangement is made that, when the butterfly valve 7 has rotated to the border angle on the closed side of the second rotation angle range, the changeover valve 8 will become a fully-opened state and, even if the butterfly valve 7 thereafter rotates to the opened-posture side and consequently the changeover valve 8 further moves upward, the ventilation resistance in the gas supply passage 4 will be maintained at the value of the fully-opened state.

Figure 5:
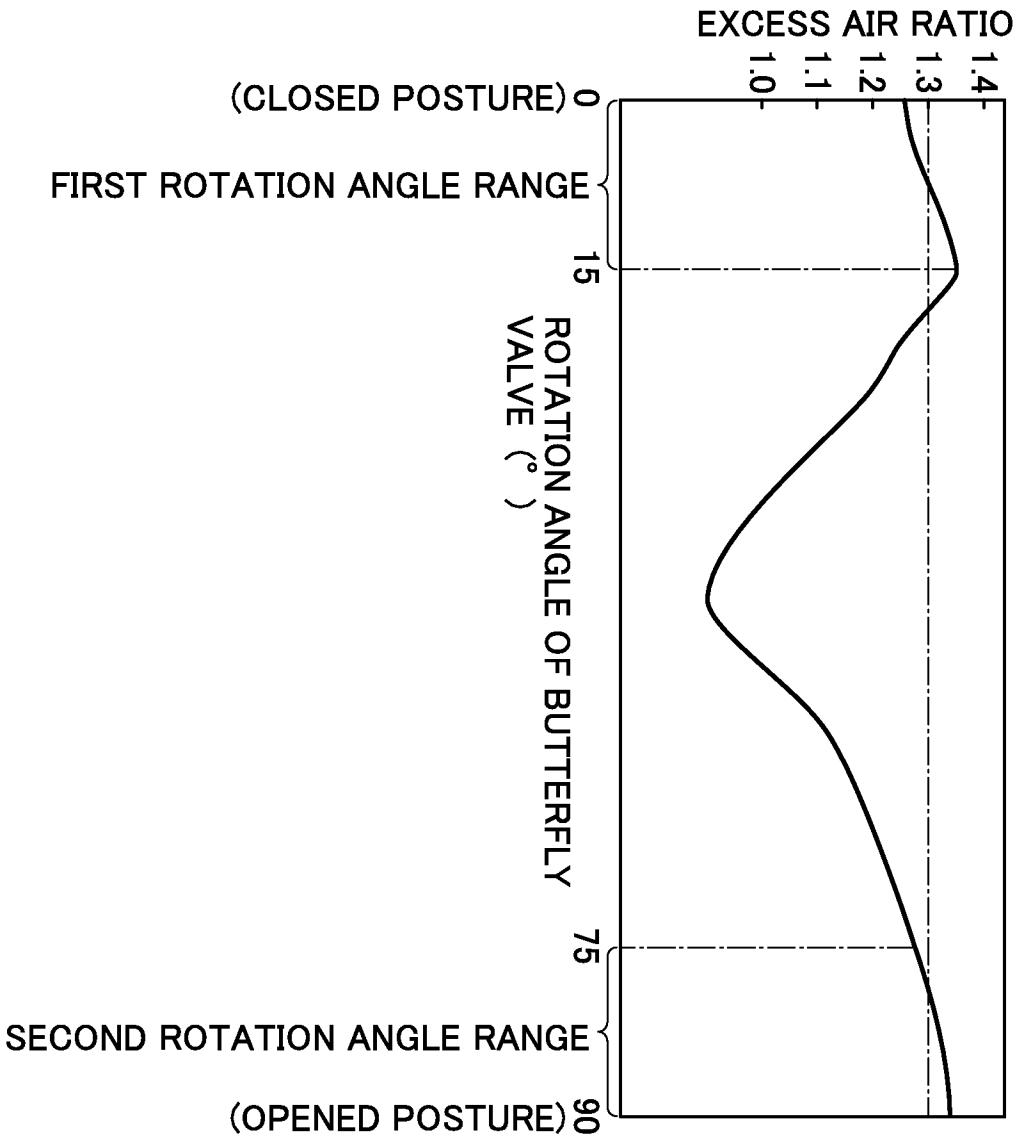
FIG. 5 is a graph showing the change in excess air ratio of air-fuel mixture accompanied by the change in the rotation angle of the butterfly valve.

FIG. 5 shows the relationship between the rotation angle of the butterfly valve 7 and the excess air ratio of the air-fuel mixture. In case the butterfly valve 7 is rotated from the closed posture to the opened posture, the changeover valve 8 is maintained in the fully-closed state within the first rotation angle range, and only the rotation angle of the butterfly valve 7 will be changed. Therefore, accompanied by the increase in the rotation angle of the butterfly valve 7, the ventilation resistance in the air supply passage 3 will decrease, and the excess air ratio of the air-fuel mixture will gradually increase. In case the butterfly valve 7 has rotated to the opening side beyond the first rotation angle range, the changeover valve 8 will be started to be subjected to opening operation, and the excess air ratio of the air-fuel mixture will gradually decrease. Thereafter, at the time when the butterfly valve 7 has been rotated to the intermediate angle between the closed posture and the opened posture, the excess air ratio of the air fuel mixture becomes minimum. When, on the other hand, the butterfly valve 7 lies within the second rotation angle range, the changeover valve 8 will be maintained in the fully-opened state, and only the rotation angle of the butterfly valve 7 changes. Therefore, accompanied by the increase in the rotation angle of the butterfly valve 7, the excess air ratio of the air-fuel mixture will gradually increase.

By the way, the apparatus is generally designed such that, in a state in which the butterfly valve 7 is rotated to the closed posture and to the opened posture, the excess air ratio of the air-fuel mixture becomes an appropriate value (an appropriate value, e.g., 1.3, for stable combustion after ignition). However, due to dimensional errors and the like of the air supply passage 3, in a state in which the butterfly valve 7 is rotated to the closed posture and to the opened posture, there are cases where the excess air ratio of the air-fuel mixture will deviate from the appropriate value.

As a solution, in this invention, the apparatus is designed such that, in a state in which the butterfly valve 7 is rotated to an intermediate angle between the respective first and the second rotation angle ranges, the excess air ratio of the air-fuel mixture becomes an appropriate value. According to this arrangement, in a state in which the butterfly valve 7 has been rotated to the intermediate angle, even if the excess air ratio of the air-fuel mixture deviates from the appropriate value, the excess air ratio of the air-fuel mixture becomes the appropriate value when the butterfly valve 7 is rotated to any one of the angles within each of the first and the second rotation angle ranges. Then, in the inspection step of the apparatus, the butterfly valve 7 is rotated within the first rotation angle range to thereby find out the rotation angle of the butterfly valve 7 at which the excess air ratio of the air-fuel mixture becomes the appropriate value. Then, this rotation angle is set as the closing-side stop angle. At the time of changing over to the small-capacity state, the butterfly valve 7 is rotated to the opening-side stop angle and then stop there. Similarly, the butterfly valve 7 is rotated within the second rotation angle range to thereby find out the rotation angle of the butterfly valve 7 at which the excess air ratio of the air-fuel mixture becomes the appropriate value. Then, this rotation angle is set as the opening-side stop angle. At the time of changing over to the large-capacity state, the butterfly valve 7 is rotated to the opening-side stop angle and then stop there. According to this arrangement, in either of the small-capacity state and the large-capacity state, adjustments can be made without the necessity of replacing the parts so as to attain the appropriate value of the excess air ratio of the air-fuel mixture.

By the way, in order to prevent the explosive ignition of the burner 1, the igniting operation of the burner 1 (in order for an ignition electrode, not illustrated, facing the ignition surface 1*a*, to cause sparks) must be performed in the small-capacity state. Here, it is at the time when the butterfly valve 7 is rotated to the closed posture that the excess air ratio of the air-fuel mixture becomes the lowest within the range of the first rotation angle. Therefore, the ignition operation of the burner 1 is arranged to be performed in a state in which the butterfly valve 7 is rotated to the closed posture. According to this arrangement, the ignition operation is performed in a state in which the excess air ratio of the air-fuel mixture is relatively low and in an easily ignitable gas-rich state. The occurrence of ignition failure can thus be prevented. After the ignition, the butterfly valve 7 is rotated to the closing-side stop angle (in case the required combustion amount is small, thereby making the state to a small-capacity state) or to the open-side stop angle (in case the required combustion amount is large, thereby making the state to a large-capacity state).

Explanation has so far been made of embodiments of this invention with reference to the drawings. However, this invention shall not be limited to the above, but may be carried out by variously modifying the invention within a range not departing from the essence of this invention.

REFERENCE SIGNS LIST

A premixing apparatus
1 burner
2 fan
3 air supply passage
31 gas suction section
4 gas supply passage
6 flow control valve
7 butterfly valve
8 changeover valve
9 interlocking mechanism

What is claimed is:

1. A method of controlling a premixing apparatus that mixes fuel gas with air and supplies thus obtained air-fuel mixture, through a fan, to a burner, the premixing apparatus being so arranged that a downstream end of a gas supply passage having interposed therein a flow control valve for supplying fuel gas is connected to a gas suction section disposed in an air supply passage on an upstream side of the fan, the premixing apparatus comprising:

an air resistance changeover means for changing over, between high and low, a first ventilation resistance in a first section of the air supply passage wherein the first section is on an upstream side of the gas suction section; and a gas resistance changeover means for changing over, between high and low, a second ventilation resistance in a second section of the gas supply passage wherein the second section is on the downstream side of the flow control valve, the air resistance changeover means being constituted by a butterfly valve disposed in the first section of the air supply passage so as to be rotatable into an opened posture parallel with a longitudinal direction of the air supply passage or a closed posture at right angles to the longitudinal direction of the air supply passage, and the gas resistance changeover means being constituted by a changeover valve disposed in the gas supply passage in an openable and closable manner, and the premixing apparatus further comprising an interlocking mechanism to open or close the changeover valve in interlocking relationship with a rotation of the butterfly valve into the opened posture or into the closed posture, wherein the interlocking mechanism is arranged to maintain the changeover valve in a fully-closed state when the butterfly valve lies in a predetermined first rotation angle range inclusive of the closed posture, and to maintain the changeover valve in a fully-opened state when the butterfly valve lies in a predetermined second rotation angle range inclusive of the opened posture;

wherein the method of controlling the premixing apparatus comprises:

a step of setting the rotation angle of the butterfly valve within the first rotation angle range to a closing-side stop angle of the butterfly valve at which an excess air ratio of the air-fuel mixture becomes a predetermined value;

a step of setting the rotation angle of the butterfly valve within the second rotation angle range to an open-side stop angle of the butterfly valve at which an excess air ratio of the air-fuel mixture becomes a predetermined value;

at a time of changing over to a small-capacity state in which the first ventilation resistance in the air supply passage is increased relative to a large capacity state and also in which the second ventilation resistance in the gas supply passage is increased relative to the large capacity state, a step of rotating the butterfly valve down to the closing side stop angle; and at a time of changing over to a large-capacity state in which the first ventilation resistance in the air supply passage is decreased relative to a small capacity state and also in which the second ventilation resistance in the gas supply passage is decreased relative to the small capacity state, a step of rotating the butterfly valve up to the open-side stop angle.

2. The method of controlling the premixing apparatus according to claim 1, further comprising a step of performing an ignition operation for the burner in a state in which the butterfly valve is rotated to the closed posture.

* * * * *